US008950750B2

(12) United States Patent
Wakabayashi et al.

(10) Patent No.: US 8,950,750 B2
(45) Date of Patent: Feb. 10, 2015

(54) SHEET THICKNESS DETECTOR AND IMAGE FORMING APPARATUS INCLUDING SAME

(71) Applicants: Yuu Wakabayashi, Kanagawa (JP); Ryo Takenaka, Tokyo (JP); Masashi Satoh, Kanagawa (JP); Shingo Nishizaki, Kanagawa (JP); Yusuke Ozaki, Tokyo (JP); Yuji Ikeda, Kanagawa (JP); Hiroshi Okamura, Tokyo (JP); Naohiro Funada, Kanagawa (JP); Tomohide Kondoh, Kanagawa (JP)

(72) Inventors: Yuu Wakabayashi, Kanagawa (JP); Ryo Takenaka, Tokyo (JP); Masashi Satoh, Kanagawa (JP); Shingo Nishizaki, Kanagawa (JP); Yusuke Ozaki, Tokyo (JP); Yuji Ikeda, Kanagawa (JP); Hiroshi Okamura, Tokyo (JP); Naohiro Funada, Kanagawa (JP); Tomohide Kondoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/930,355

(22) Filed: Jun. 28, 2013

(65) Prior Publication Data

US 2014/0015192 A1 Jan. 16, 2014

(30) Foreign Application Priority Data

Jul. 11, 2012 (JP) ..... 2012-155353
Dec. 25, 2012 (JP) ..... 2012-280927

(51) Int. Cl.

| | |
|---|---|
| ***B65H 5/02*** | (2006.01) |
| ***B65H 5/04*** | (2006.01) |
| ***B65H 7/12*** | (2006.01) |
| ***G03G 15/00*** | (2006.01) |

(52) U.S. Cl.

CPC ..... *B65H 7/12* (2013.01); *G03G 15/5029* (2013.01); *G03G 2215/00628* (2013.01); *G03G 2215/00738* (2013.01)

USPC ..... 271/274; 271/262; 271/263; 271/265.04; 271/273

(58) Field of Classification Search

USPC ..... 271/262, 263, 265.04, 273, 274

See application file for complete search history.

(56) References Cited

U.S. PATENT DOCUMENTS

| | | | | |
|---|---|---|---|---|
| 5,174,562 | A * | 12/1992 | Mizunaga et al. | 271/261 |
| 5,238,123 | A * | 8/1993 | Tovini et al. | 209/556 |
| 6,278,270 | B1 * | 8/2001 | Robles-Flores et al. | 324/207.21 |
| 6,705,609 | B2 * | 3/2004 | Kim | 271/262 |
| 7,344,016 | B2 * | 3/2008 | Vogel et al. | 198/412 |

(Continued)

FOREIGN PATENT DOCUMENTS

| | | |
|---|---|---|
| JP | 2003-149887 | 5/2003 |
| JP | 2008-044739 | 2/2008 |

(Continued)

*Primary Examiner* — Prasad Gokhale

(74) *Attorney, Agent, or Firm* — Harness, Dickey & Pierce

(57) ABSTRACT

A sheet thickness detector incorporated in an image forming apparatus includes a sheet conveying member to rotate and convey a sheet in a sheet conveyance direction, a driven sheet conveying member to contact the sheet conveying member and form at least one first transfer nip therebetween in a lateral direction and to displace by an amount equivalent to a thickness of the sheet passing through the first transfer nip and rotated with the sheet conveying member in the sheet conveyance direction, a displacement member to contact the sheet conveying member and form a second transfer nip smaller than the first transfer nip in the lateral direction and to displace by an amount equivalent to the thickness of the sheet passing through the second transfer nip and supported at a support member, and a displacement amount detector to detect an amount of displacement of the displacement member.

20 Claims, 10 Drawing Sheets

(56) References Cited

U.S. PATENT DOCUMENTS 7,654,523 B2 * 2/2010 Tsukamoto et al. ..... 271/262
7,896,342 B2 * 3/2011 Tsukamoto et al. ..... 271/265.04

FOREIGN PATENT DOCUMENTS

JP 2008-247612 10/2008
JP 2009-190876 8/2009

* cited by examiner

SHEET THICKNESS DETECTOR AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application Nos. 2012-155353, filed on Jul. 11, 2012 and 2012-280927, filed on Dec. 25, 2012 in the Japan Patent Office, the entire disclosures of which are hereby incorporated by reference herein.

BACKGROUND

1. Technical Field

Embodiments of the present invention generally relate to a sheet thickness detector to detect the thickness of a sheet to be supplied, and an image forming apparatus incorporating the sheet thickness detector.

2. Related Art

In image forming apparatuses such as printers, copiers, and facsimile machines forming an image on a sheet of recording medium, image forming conditions are optimized according to sheet thickness for producing a high-quality image.

However, such optimization includes complicated and/or costly configurations, and provides uneven detection results.

In a transfer process for transferring toner to the recording medium, a volume resistance varies depending on a thickness of a sheet. Therefore, a transfer current to drive a transfer charger needs to be changed according to the thickness of a sheet. Further, in a fixing process for fixing toner on a sheet to the sheet by application of heat and pressure, the appropriate quantity of heat is different according to the thickness of a sheet. Therefore, the temperature changes according to the thickness of the sheet.

A sheet thickness detector of an example includes a reference roller, a detection roller, and a detection lever. The detection lever has one end that is attached to the detection roller to detect an amount of displacement of a surface of the detection roller and the other end that is a free end to move in a direction that the detection roller separates from the reference roller, that is, a direction of thickness of a sheet and in an axial direction of the reference roller.

The detection roller in the sheet thickness detector of the present example has a rotary shaft that has a length greater than the entire lateral length of a sheet in a direction perpendicular to the sheet conveyance direction, which is the entire width thereof. Since the detection roller is rotated about the rotary shaft in the sheet conveyance direction, detection of an amount of displacement with respect to the rotary shaft or surface of the detection roller indicates the amount of displacement including disposition or eccentricity of the rotary shaft. Therefore, the amount of displacement by an amount equivalent to the thickness of the sheet may not be detected accurately.

In a sheet thickness detector of another example, the diameter of a part of at least one of a reference roller and a detection roller is reduced. A displacement member that is displaced according to the passage of a sheet of recording medium is arranged at the part of the reduced diameter while being engaged with one of the reference roller and the detection roller. With this configuration of the second example, the thickness of the sheet is detected based on the amount of displacement of the displacement member.

Even though not having a configuration that directly detects the amount of displacement of the detection roller, the sheet thickness detector of this example has a configuration that detects an amount of displacement of a displacement member operating together with the detection roller, and therefore is negatively affected by rotational fluctuation of the detection roller. Further, this configuration is so complicated to install in a compact image forming apparatus, which is likely to increase its manufacturing cost.

Similarly, in a sheet thickness detector of yet another example, the diameter of a part of at least one of a reference roller and a detection roller is reduced. However, a displacement member that is displaced according to the passage of a sheet of recording medium is arranged at the part of the reduced diameter while being separated from the reference roller and the detection roller. With this configuration of the second example, the thickness of the sheet is detected based on the amount of displacement of the displacement member.

The sheet thickness detector of this example in which the detection roller and the displacement member operate separately is expected to avoid the negative effect due to the rotational fluctuation of the detection roller. However, the complicated configuration of the displacement member makes it difficult to provide the displacement member in a space-saving device or apparatus such as an image forming apparatus, which is also likely to increase the cost.

SUMMARY

The present invention provides a novel sheet thickness detector including a sheet conveying member to rotate and convey a sheet in a sheet conveyance direction, a driven sheet conveying member to contact the sheet conveying member and form at least one first transfer nip therebetween in a predetermined range in a lateral direction perpendicular to the sheet conveyance direction and be biased to displace by an amount equivalent to a thickness of the sheet passing through the at least one first transfer nip and rotated about a rotary shaft thereof with the sheet conveying member in the sheet conveyance direction, a first displacement member to contact the sheet conveying member and form a second transfer nip that is smaller than the at least one first transfer nip in the lateral direction and be biased to displace by an amount equivalent to the thickness of the sheet passing through the second transfer nip, a first support member having a free end at which the first displacement member is supported, and a displacement amount detector to detect the amount of displacement of the first displacement member.

Further, the present invention provides a novel image forming apparatus including the above-described sheet thickness detector and a controller to control an image forming process condition based on a detected value obtained by the sheet thickness detector.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
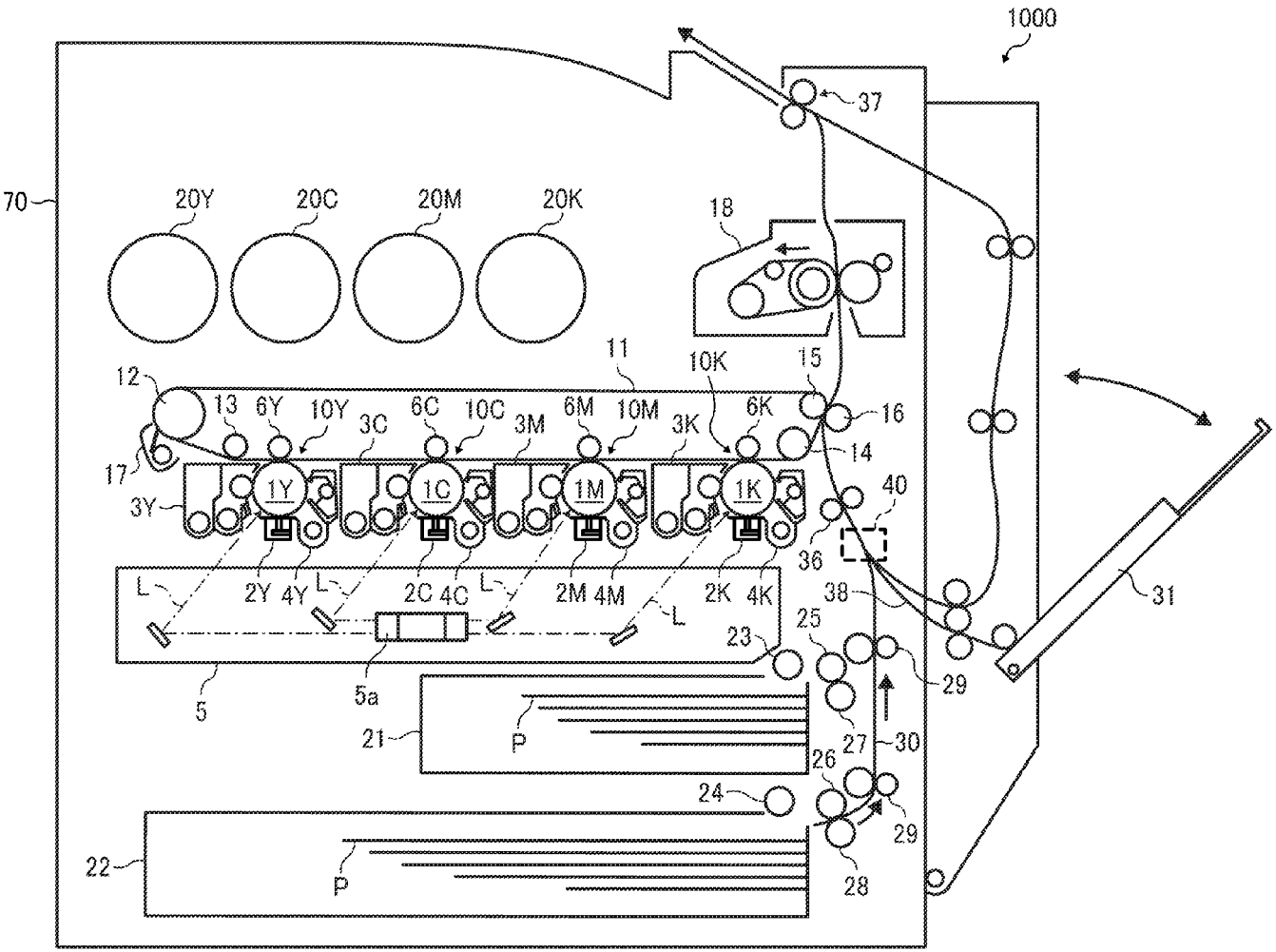
FIG. 1 is a diagram illustrating a schematic configuration of an image forming apparatus according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

Figure 2:
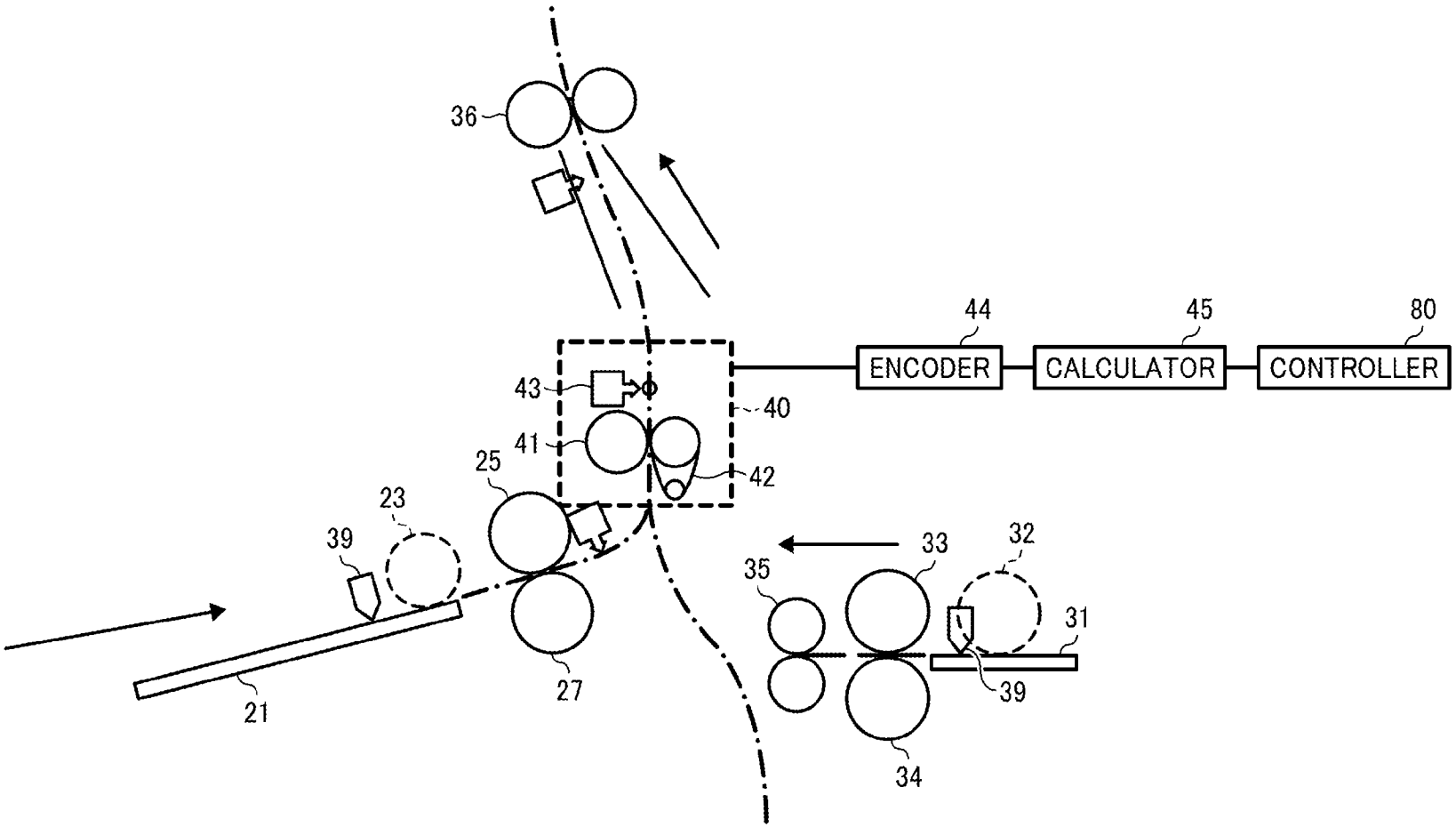
FIG. 2 is a schematic diagram illustrating a sheet path of the image forming apparatus of FIG. 1.

A description is given of a configuration of an electrophotographic image forming apparatus according to an embodiment of the present invention, with reference to FIGS. 1 and 2.

FIG. 1 is a diagram illustrating a schematic configuration of an image forming apparatus 1000 according to an embodiment of the present invention. FIG. 2 is a schematic diagram illustrating a sheet path (a sheet path 30 and a bypass sheet path 38) of the image forming apparatus 1000 of FIG. 1.

As illustrated in FIGS. 1 and 2, the image forming apparatus 1000 may be a copier, a facsimile machine, a printer, a multifunction printer having at least one of copying, printing, scanning, plotter, and facsimile functions, or the like. The image forming apparatus 1000 may form an image by an electrophotographic method, an inkjet method, and/or the like. According to this embodiment, the image forming apparatus 1000 functions as a color printer for forming a color image on a recording medium by the electrophotographic method.

As illustrated in FIG. 1, the image forming apparatus 1000 includes a body 70 to contain units and components for image forming such as four image forming devices 10Y, 10C, 10M, and 10K, an optical writing device 5, an intermediate transfer belt 11, a fixing device 18, toner bottles 20Y, 20C, 20M, and 20K, and sheet trays 21 and 22.

The image forming devices 10Y, 10C, 10M, and 10K for forming respective toner images of yellow (Y), cyan (C), magenta (M), and black (K) include drum-shaped photoconductors 1Y, 1C, 1M, and 1K, respectively. Around each photoconductor 1 (i.e., the photoconductors 1Y, 1C, 1M, and 1K), a charging device 2 (i.e., charging devices 2Y, 2C, 2M, and 2K) for uniformly charging the surface of the photoconductor 1, a development device 3 (i.e., development devices 3Y, 3C, 3M, and 3K) for developing an electrostatic latent image to a visible tone image, a cleaning device 4 (i.e., cleaning devices 4Y, 4C, 4M, and 4K) for cleaning the surface of the photoconductor 1 by removing residual toner remaining thereon, and the like are disposed.

The optical writing device 5 is disposed below the image forming devices 10Y, 10C, 10M, and 10K to form electrostatic latent images on respective surfaces of the photoconductors 1Y, 1C, 1M, and 1K. The optical writing device 5 includes a light source that emits laser light beams L and a polygon mirror 5*a* that is rotated by a motor. The laser light beams L emitted by the light source are deflected by the polygon mirror 5*a* and reflected by multiple optical lenses and mirrors to irradiate the surfaces of the photoconductors 1Y, 1C, 1M, and 1K. The configuration of the optical writing device 5 is not limited thereto. For example, a configuration employing an LED array is also applicable to the present embodiment.

In the image forming apparatus 1000, each of the image forming devices 10Y, 10C, 10M, and 10K is a process cartridge that is detachably attached to the body 70. However, the configuration of the image forming devices 10Y, 10C, 10M, and 10K is not limited thereto. For example, the charger 2, the development device 3, and the cleaning device 4 can be provided separate from the photoconductor 1. Even so, it is preferable that the units and components disposed around the photoconductor 1 are assembled as a process cartridge from a view point of machine maintenance such as repair, replacement, and adjustment of the units and components.

The intermediate transfer belt 11 receives toner images formed in the image forming devices 10Y, 10C, 10M, and 10K. The intermediate transfer belt 11 is wound about a plurality of rollers 12, 13, 14, and 15. Primary transfer rollers 6Y, 6C, 6M, and 6K for primary transfer are disposed facing the photoconductors 1Y, 1C, 1M, and 1K, respectively, where respective primary transfer nips are formed. A secondary transfer roller 16 for secondary transfer is disposed facing the roller 15, where a secondary transfer nip is formed. Further, a belt cleaning device 17 is disposed facing the roller 12 for cleaning the surface of the intermediate transfer belt 11.

The fixing device 18 is disposed above the secondary transfer roller 16 to fix the toner image to a paper P that functions as a recording sheet.

The toner bottles 20Y, 20C, 20M, and 20K are disposed at an upper part of the image forming apparatus 1000. The toner bottles 20Y, 20C, 20M, and 20K are connected to the development devices 3Y, 3C, 3M, and 3K, respectively, via toner supply pipes corresponding thereto. Respective toners contained in the toner bottles 20Y, 20C, 20M, and 20K are supplied to the development devices 3Y, 3C, 3M, and 3K, accordingly. Each of the toner bottles 20Y, 20C, 20M, and 20K is detachably attached to the body 70 of the image forming apparatus 1000. When the toner in any of the toner bottles 20Y, 20C, 20M, and 20K is consumed, the empty toner bottle is replaced with a new bottle.

The sheet containers 21 and 22 are located vertically below the optical writing device 5 to accommodate a stack of papers including a paper P functioning as recording media sheets to be fed to the image forming devices 10Y, 10C, 10M, and 10K. The sheet containers 21 and 22 are detachably attachable to the body 70 and can choose paper types to be loaded thereon.

In addition to the sheet containers 21 and 22, a bypass tray 31 is attached to the body 70 at the right side of FIG. 1. The bypass tray 31 is openably closable in a direction indicated by arrow in FIG. 1 to feed the paper P therefrom to the image forming devices 10Y, 10C, 10M, and 10K. In the present embodiment, in addition to regular papers such as A4-size papers and B5-size papers, special papers such as a thick paper and an envelope, both having a thickness greater than the regular papers, can be loaded on the bypass tray 31. The special papers can be loaded on the sheet containers 21 and 22 by detaching from the body 70 or inserted from the bypass tray 31.

As illustrated in FIGS. 1 and 2, the sheet containers 21 and 22 includes pickup rollers 23 and 24, respectively. The pickup rollers 23 and 24 can contact and separate from an uppermost sheet of the stack of papers including the paper P accommodated in the sheet container 21 or 22 and rotate in the sheet conveyance direction while contacting the uppermost sheet.

Feed rollers 25 and 26 are disposed downstream from the pickup rollers 23 and 24, respectively, in the sheet conveyance direction to convey the paper P fed by the pickup rollers 23 and 24. Separation rollers 27 and 28 are disposed facing and contacting the feed rollers 25 and 26, respectively. The separation rollers 27 and 28 can rotate in a backward direction to rotation of the feed rollers 25 and 26, respectively, via a torque limiter. A sheet path 30 is defined by multiple pairs of conveyance rollers 29 disposed downstream from the feed rollers 25 and 26 in the sheet conveyance direction to convey the paper P while holding it between the multiple pairs of conveyance rollers 29.

Further, each of the sheet containers 21 and 22 includes multiple photosensors including a paper end sensor 39, a paper side sensor, and a tray setting sensor. The paper end sensor 39 detects the quantity of papers left in the sheet containers 21 and 22. The paper side sensor detects the size and direction of paper P. The tray setting sensor detects whether the sheet containers 21 and 22 are attached to the body 70 of the image forming apparatus 1000.

The sheet path 30 includes sensors including a sheet conveyance sensor that detects whether the paper P is properly conveyed and whether a conveyance failure such as a paper jam is occurring.

Similar to the sheet containers 21 and 22, the bypass tray 31 includes a bypass pickup roller 32 that can contact and separate from the uppermost sheet of the stack of papers including the paper P accommodated in the bypass tray 31 and rotate in the sheet conveyance direction while contacting the uppermost sheet. A bypass feed roller 33 is disposed downstream from the bypass pickup roller 32 in the sheet conveyance direction to convey the paper P fed by the bypass pickup roller 32. A bypass separation roller 34 is disposed facing and contacting the bypass feed roller 33. The bypass separation roller 34 can rotate in a backward direction to rotation of the bypass feed roller 33 via a torque limiter. A bypass sheet path 38 is defined downstream from the bypass feed roller 33 in the sheet conveyance direction and includes a pair of bypass conveyance rollers 35 to guide the bypass sheet path 38 to meet and merge with the sheet path 30.

A pair of registration rollers 36 is disposed at the distal end of the sheet path 30 and the bypass sheet path 38. Upon holding the paper P conveyed by the multiple pairs of conveyance rollers 29, the pair of registration rollers 36 temporarily stops its rotation. In synchronization with movement of a toner image formed on the surface of the intermediate transfer belt 11, the pair of registration rollers 36 restarts and conveys the paper P toward the secondary nip.

Next, a description is given of image forming operations performed in the image forming apparatus 1000 having the above-described configuration, with reference to FIGS. 1 and 2.

After being fed from one of the sheet containers 21 and 22 and the bypass tray 31, the paper P is conveyed by the corresponding one of the pickup rollers 23, 24, and 32 into the sheet path 30. While being held between the multiple pairs of conveyance rollers 29, the paper P travels in the sheet path 30 upward in FIG. 1. The paper P stops at the pair of registration rollers 36 to synchronize with movement of an image to be formed and carried on the surface of the intermediate transfer belt 11.

The photoconductors 1Y, 1C, 1M, and 1K are uniformly charged by the charging devices 2Y, 2C, 2M, and 2K, respectively, and irradiated by the laser light beams L by the optical writing device 5 to form respective electrostatic latent images thereon. The development devices 3Y, 3C, 3M, and 3K supply corresponding color toners to the respective electrostatic latent images to develop the respective electrostatic latent images formed on the photoconductors 1Y, 1C, 1M, and 1K into yellow, cyan, magenta, and black toner images.

Respective voltages are applied to the primary transfer rollers 6Y, 6C, 6M, and 6K, so that the toner images on the photoconductors 1Y, 1C, 1M, and 1K are sequentially transformed onto the surface of the intermediate transfer belt 11. To form a composite image on the same area of the intermediate transfer belt 11 properly, the toner images are transferred onto the surface of the intermediate transfer belt 11 one by one at respective predetermined timings from upstream to downstream.

The toner image formed on the surface of the intermediate transfer belt 11 is conveyed to the secondary transfer roller 16 where the secondary transfer nip is formed with the roller 15. In synchronization with this movement of the intermediate transfer belt 11 having the toner image thereon, the paper P standing by at the pair of registration rollers 36 is conveyed to the secondary transfer roller 16 to receive the toner image from the intermediate transfer belt 11. Then, the paper P having the toner image thereon is conveyed to the fixing device 18 in which the toner image is fixed to the paper P. Thereafter, the paper P is discharged by a pair of discharging rollers 37 to the outside of the body 70 of the image forming apparatus 1000.

As illustrated in FIGS. 1 and 2, the image forming apparatus 1000 according to the present embodiment further includes a sheet thickness detector 40 and a controller 80.

The sheet thickness detector 40 is disposed downstream from a meeting point of the sheet path 30 and the bypass sheet path 38 and upstream from the pair of registration rollers 36 in the sheet conveyance direction. The sheet thickness detector 40 detects the thickness of the paper P used for image forming.

The controller 80 provided in the body 70 controls image forming process conditions based on values detected by the sheet thickness detector 40.

Here, a description is given of configurations of comparative examples of sheet thickness detectors provided in an image forming apparatus, with reference to FIGS. 3A, 3B, 4A, 4B, 5A, 5B, 6A, and 6B.

Figure 3A:
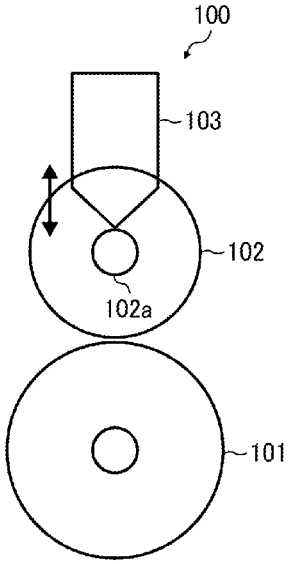
FIG. 3A is a diagram illustrating a state in which no sheet passes through a nip in the comparative sheet thickness detector.
Figure 3B:
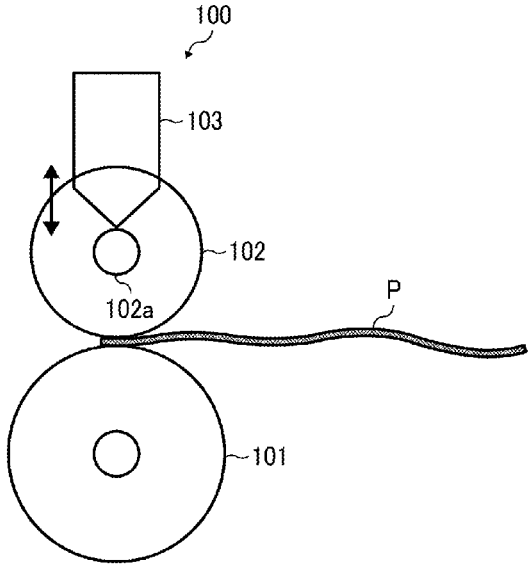
FIG. 3B is a diagram illustrating a state in which a sheet passes through a nip in the comparative sheet thickness detector.

As one example, a sheet thickness detector 100 that is illustrated in FIGS. 3A and 3B is disposed in a sheet path to detect the thickness of a sheet. The sheet thickness detector 100 includes a reference roller 101 functioning as a sheet conveying member, a detection roller 102 having a rotary shaft 102*a* and functioning as a driven sheet conveying member, and a detector 103 to detect existence of the paper P in a transfer nip formed between the reference roller 101 and the detection roller 102. The paper P is conveyed by being held in the transfer nip and the position of the rotary shaft 102*a* may change depending on existence of the paper P at the transfer nip. An amount of differential of the rotary shaft 102*a* of the detection roller 102 is calculated based on detection results obtained by the detection unit 103. Thus, the thickness of the paper P is detected.

Figure 4A:
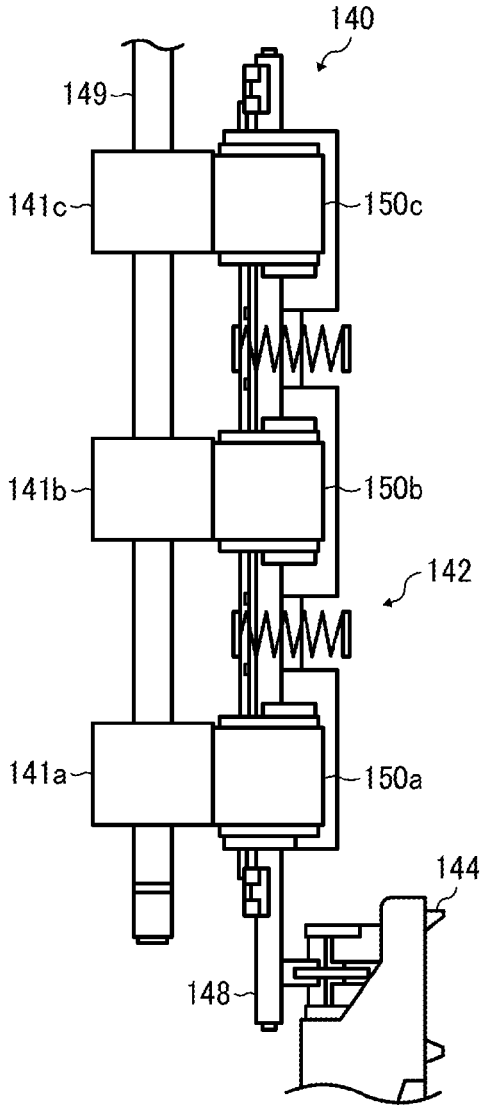
FIG. 4A is a top view illustrating a comparative sheet thickness detector.
Figure 4B:
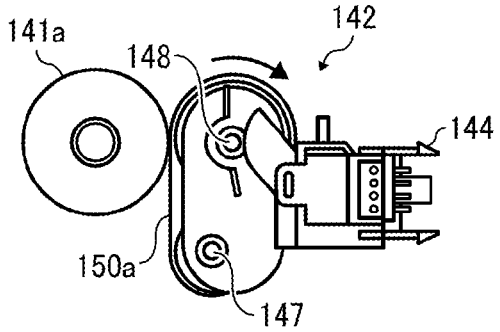
FIG. 4B is a side view illustrating the sheet thickness detector of FIG. 4A.
Figure 5B:
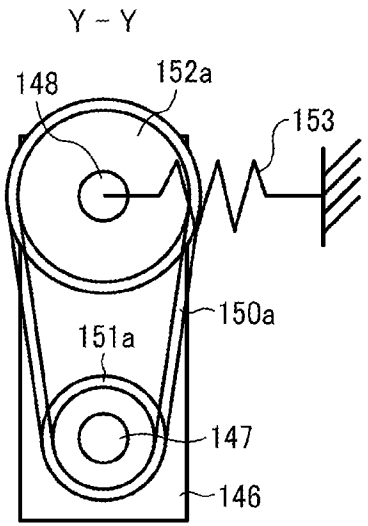
FIG. 5B is a cross-sectional view illustrating the comparative sheet thickness detector of FIG. 5A along a line Y-Y of FIG. 5A.
Figure 5A:
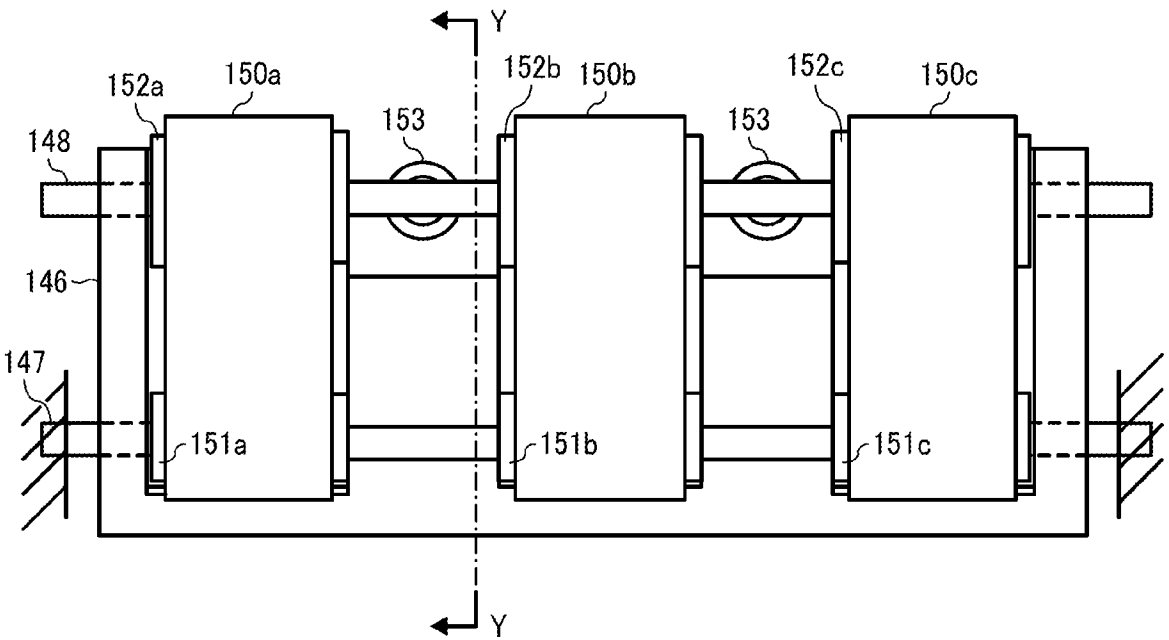
FIG. 5A is a side view illustrating the comparative sheet thickness detector, viewed along a longitudinal direction.
Figure 6B:
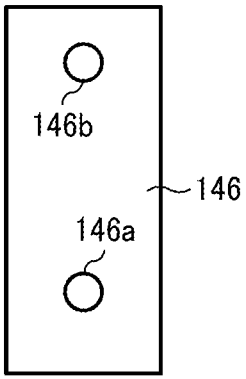
FIG. 6B is a side view illustrating the belt holder of FIG. 6A.

As another example, a sheet thickness detector 140 has a configuration as illustrated in FIGS. 4A through 6B. FIG. 4A is a top view illustrating the sheet thickness detector 140. FIG. 4B is a side view illustrating the sheet thickness detector of FIG. 4A, viewed along its lateral direction. FIG. 5A is a side view illustrating the sheet thickness detector 140, viewed along its longitudinal direction. FIG. 5B is a cross-sectional view illustrating the sheet thickness detector 140 of FIG. 5A along a line Y-Y of FIG. 5A. FIG. 6A is a side view illustrating a belt holder 146 of the sheet thickness detector 140, viewed along its longitudinal direction. FIG. 6B is a side view illustrating the belt holder 146 of FIG. 6A, viewed along its lateral direction.

The sheet thickness detector 140 illustrated in FIGS. 4A through 6B includes driving rollers 141 (i.e., driving rollers 141*a*, 141*b*, and 141*c*) functioning as sheet conveying members, a driven belt unit 142 disposed facing the driving rollers 141 and displacing depending on the thickness of a sheet, and an encoder 144 functioning as a displacement amount detector to detect an amount of displacement of the driven belt unit 142 according to the thickness of a paper.

Figure 6A:
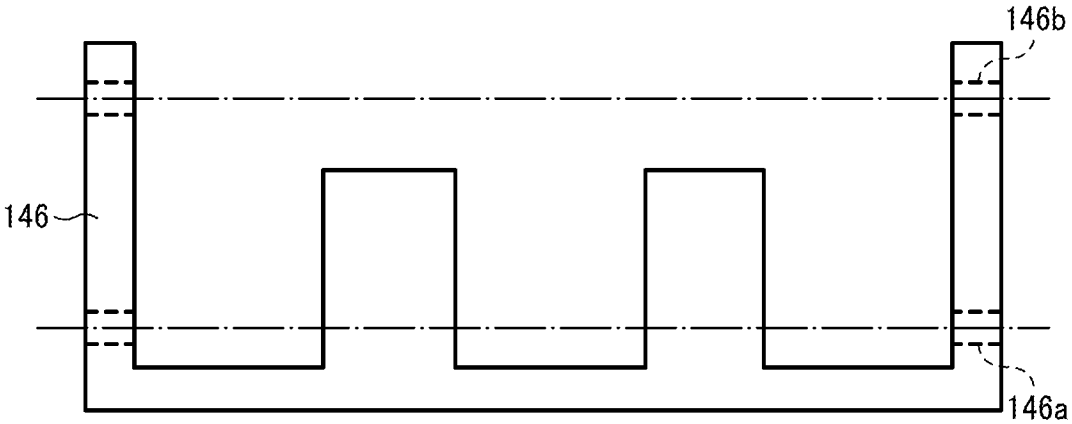
FIG. 6A is a side view illustrating a belt holder of the comparative sheet thickness detector, viewed along a longitudinal direction.

As illustrated in FIGS. 4A and 4B, the driving roller 141 (i.e., driving rollers 141*a*, 141*b*, and 141*c*) are horizontally aligned at predetermined intervals along a rotary shaft 149. The driving rollers 141*a*, 141*b*, and 141*c* are rotated in the sheet conveyance direction by a non-illustrated driving source. The driven belt unit 142 includes driven belts 150*a*, 150*b*, and 150*c* in a belt holder 146. The belt holder 146 has openings 146*a* and 146*b* formed on opposite sidewalls as illustrated in FIGS. 6A and 6B. Driven shafts 147 and 148 are disposed to pass through the openings 146*a* and 146*b*. The driven belts 150*a*, 150*b*, and 150*c* are wound about respective two pulleys disposed at predetermined intervals on the driven shafts 147 and 148.

Specifically, as illustrated in FIGS. 5A and 5B, the driven belt 150*a* is stretched taut by a pulley 151*a* supported by the driven shaft 147 and a pulley 152*a* supported by the driven shaft 148, contacts the driving roller 141*a* to form a nip, and rotates with the driving roller 141*a*. Similarly, the driven belt 150*b* is stretched taut by a pulley 151*b* supported by the driven shaft 147 and a pulley 152*b* supported by the driven shaft 148, contacts the driving roller 141*b* to form a nip, and rotates with the driving roller 141*b*, and the driven belt 150*c* is stretched taut by a pulley 151*c* supported by the driven shaft 147 and a pulley 152*c* supported by the driven shaft 148, contacts the driving roller 141*c* to form a nip, and rotates with the driving roller 141*c*.

The driven shaft 148 is biased toward the driving rollers 141*a*, 141*b*, and 141*c* by two springs 153 functioning as biasing members. According to this configuration, the driven belts 150*a*, 150*b*, and 150*c* of the driven belt unit 142 are rotatably biased by the driving rollers 141*a*, 141*b*, and 141*c*, respectively, about the driven shaft 147. The driven shaft 148 moves according to the thickness of the paper P passing through the nip formed between the driving rollers 141*a*, 141*b*, and 141*c* and the driven belt 150. A non-illustrated calculator calculates the differential of ranges of movement of the encoder 144 depending on existence of the paper P at the nip.

The sheet thickness detector 140 having the above-described configuration detects the amount of displacement of the driven shaft 148 and a surface of the driven belt 150 (i.e., the driven belts 150*a*, 150*b*, and 150*c*). However, the results contain the displacement due to shake of the driven shaft 148, especially to rotational fluctuation caused by a period of rotation of the driven belts 150*a*, 150*b*, and 150*c*, and therefore the amount of displacement corresponding to the thickness of a sheet may not be detected precisely.

Now, a description is given of details of the sheet thickness detector 40 according to the present embodiment, with reference to FIGS. 7, 8A, 8B, and 9.

Figure 7:
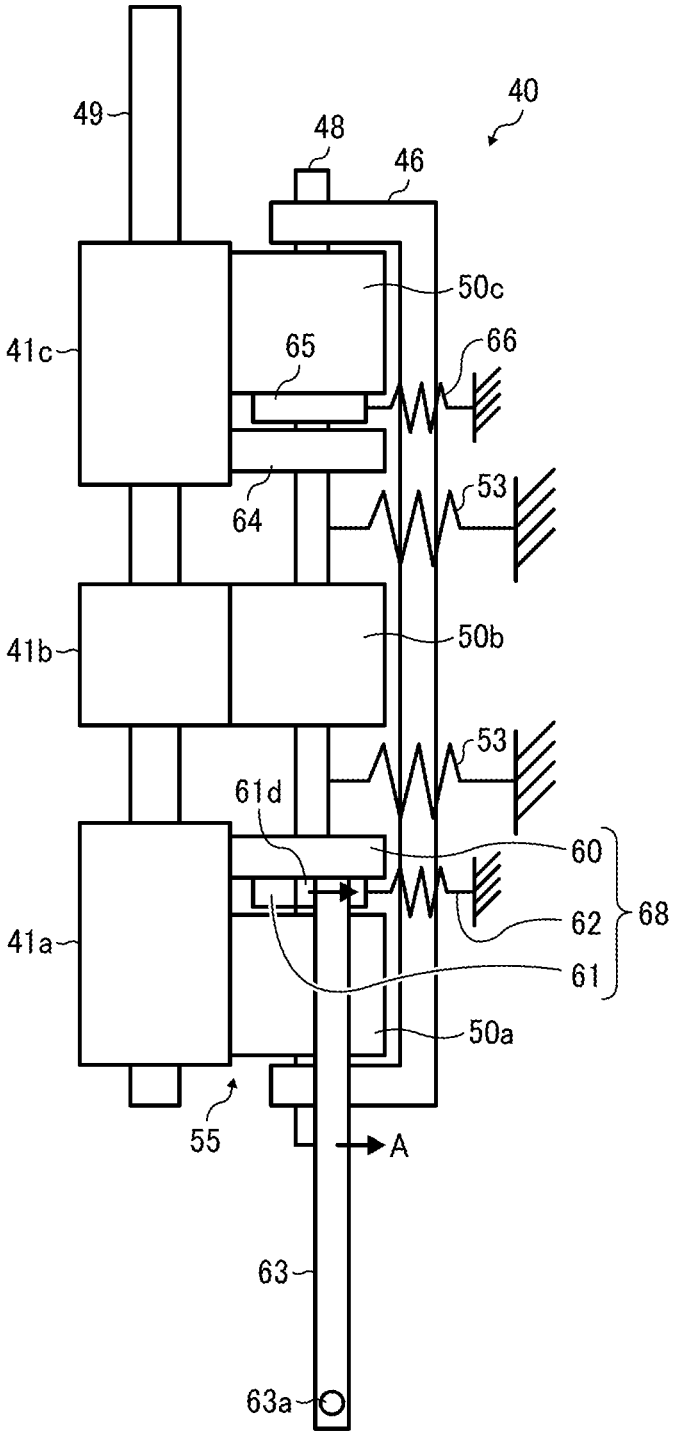
FIG. 7 is a top view illustrating a sheet thickness detector included in the image forming apparatus of FIG. 1.
Figure 8B:
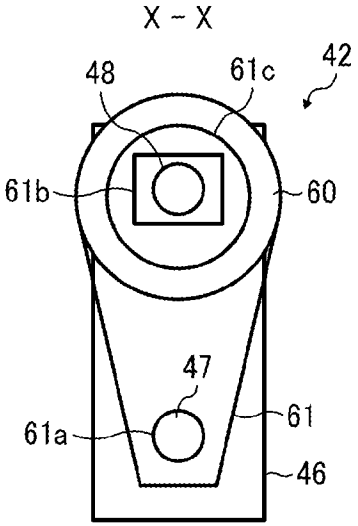
FIG. 8B is a cross-sectional view illustrating the sheet thickness detector of FIG. 8A along a line X-X of FIG. 8A.
Figure 8A:
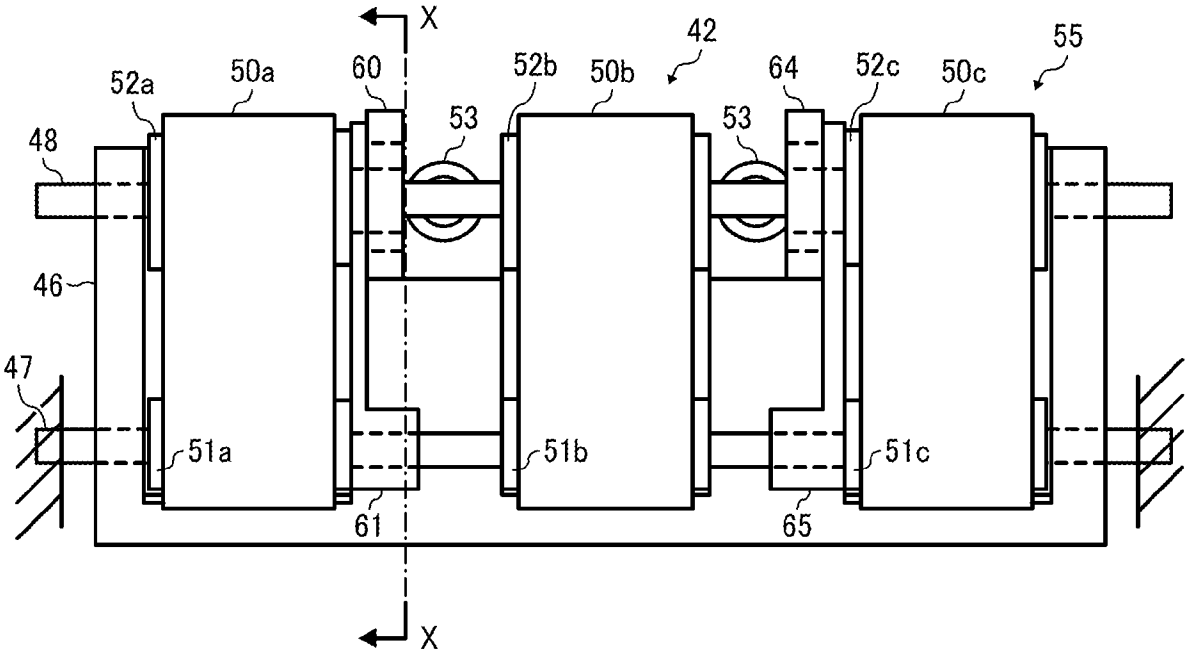
FIG. 8A is a side view illustrating the sheet thickness detector.
Figure 9:
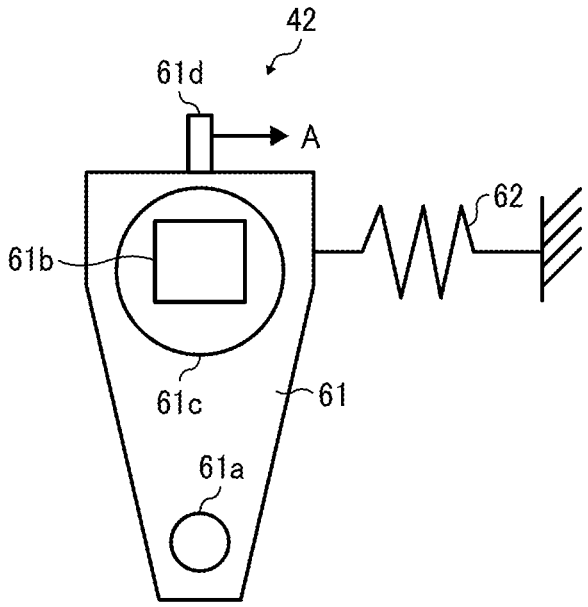
FIG. 9 is a diagram illustrating a detection holder included in the sheet thickness detector.

FIG. 7 is a top view illustrating a configuration of the sheet thickness detector 40 according to the present embodiment. FIG. 8A is a side view illustrating the sheet thickness detector 40, viewed along its longitudinal direction. FIG. 8B is a cross-sectional view illustrating the sheet thickness detector 40 of FIG. 8A along a line X-X of FIG. 8A. FIG. 9 is a diagram illustrating a detection holder included in the sheet thickness detector 40.

The sheet thickness detector 40 of FIGS. 2, 7, 8, and 9 includes driving rollers 41 (i.e., driving rollers 41*a*, 41*b*, and 41*c*), a driven belt unit 42, a sheet feed sensor 43, an encoder 44, and a calculator 45.

The driving roller 41 functions as a sheet conveying member. The driven belt unit 42 is disposed facing the driving roller 41 and moves vertically following the thickness of the paper P conveyed thereto. The sheet feed sensor 43 detects the leading edge of the paper P. The encoder 44 functions as a displacement amount detector to detect an amount of displacement according to the thickness of a sheet. The calculator 45 is operatively connected to the controller 80 and calculates the thickness of the paper P according to the detection results obtained by the encoder 44.

As illustrated in FIG. 7, the driving rollers 41*a*, 41*b*, and 41*c* are horizontally aligned at predetermined intervals along a rotary shaft 49. The driving rollers 41*a*, 41*b*, and 41*c* are rotated in the sheet conveyance direction by a non-illustrated driving source.

The driven belt unit 42 includes driven belts 50*a*, 50*b*, and 50*c*, each of which functions as a driven sheet conveying member formed by an elastic material, in a belt holder 46. The belt holder 46 has openings formed on opposite sidewalls as illustrated in FIG. 7, so that driven shafts 47 and 48 are disposed to pass through the openings. The driven belts 50*a*, 50*b*, and 50*c* are wound about respective two pulleys disposed at predetermined intervals on the driven shafts 47 and 48.

Specifically, as illustrated in FIGS. 8A and 8B, the driven belt 50*a* is stretched taut by a pulley 51*a* supported by the driven shaft 47 and a pulley 52*a* supported by the driven shaft 48, contacts the driving roller 41*a* to form a first transfer nip, and rotates with the driving roller 41*a*. The width of the driven belt 50*a* is smaller than the width of the driving roller 41*a*.

Similarly, the driven belt 50*b* is stretched taut by a pulley 51*b* supported by the driven shaft 47 and a pulley 52*b* supported by the driven shaft 48, contacts the driving roller 41*b* to form the first transfer nip, and rotates with the driving roller 41*b*. The width of the driven belt 50*b* is substantially the same as the width of the driving roller 41*b*.

Further, the driven belt 50*c* is stretched taut by a pulley 51*c* supported by the driven shaft 47 and a pulley 52*c* supported by the driven shaft 48, contacts the driving roller 41*c* to form the first transfer nip, and rotates with the driving roller 41*c*. The width of the driven belt 50*c* is smaller than the width of the driving roller 41*c*.

The driven shaft 48 is biased toward the driving rollers 41*a*, 41*b*, and 41*c* by two biasing members, which, in the present embodiment, are springs 53. According to this configuration, the driven belts 50*a*, 50*b*, and 50*c* of the driven belt unit 42 are rotatably biased by the driving rollers 41*a*, 41*b*, and 41*c*, respectively, about the driven shaft 47. The driven shaft 48 moves according to the thickness of the paper P passing between the driving rollers 41*a*, 421*b*, 41*c* and the driven belt 50. A sheet holding/conveying mechanism 55 that holds the paper P is thus formed by the driving rollers 41*a*, 41*b*, 41*c*, the driven belts 50*a*, 50*b*, and 50*c*, the rotary shaft 49, the pulleys 51*a*, 51*b*, 51*c*, 52*a*, 52*b*, 52*c*, the driven shafts 47 and 48, the belt holder 46, and the springs 53. Further, the driven belts 50*a*, 50*b*, and 50*c* can prevent the paper P from slipping on the driven belts 50*a*, 50*b*, and 50*c*.

The sheet thickness detector 40 includes a detection roller 60 and a detection holder 61. The detection roller 60 functions as a displacement member and is disposed facing the driving roller 41 in the belt holder 46. The detection holder 61 functions as a support member to which the detection roller 60 is attached. The detection roller 60 includes a metallic roller having a cylindrical hollow shape, through which the driven shaft 48 passes, and contacts the driving roller 41*a* to form a second transfer nip. Specifically, the first transfer nip is formed between the driving roller 41*a* and the driven belt 5*a* and the second transfer nip is formed between the driving roller 41*a* and the detection roller 60.

As illustrated in FIGS. 8A, 8B, and 9, the detection roller 60 is attached to the detection holder 61 separate from the driven shaft 47, so that the detection roller 60 can be rotated with conveyance of the paper P. The detection holder 61 includes a circular opening 61*a* and a slot 61*b*. The circular opening 61*a* has a diameter substantially the same as that of the driven shaft 47. The slot 61*b* has sides with a length greater than the diameter of the driven shaft 48. The driven shaft 47 passes through the circular opening 61*a*. The driven shaft 48 passes through the slot 61*b* with space therearound. With this configuration, the detection holder 61 is rotatably supported about the same fulcrum as the belt holder 46.

Further, the detection holder 61 includes a guide 61*c* having the same shape as the inner diameter of the detection roller 60. The guide 61*c* is disposed surrounding the slot 61*b*. The detection roller 60 is rotatably supported to fit the outer circumference of the guide 61*c*. The detection holder 61 is biased by a spring 62 functioning as a biasing member toward the driving roller 41*a*. As a result, the detection roller 60 is biased toward the driving roller 41*a*.

The detection roller 60 is thus attached to the free end of the detection holder 61 that rotates about the driven shaft 47. Therefore, separate from movement of the driven belt 50 including the driven shaft 48, the detection roller 60 can move in a direction indicated by arrow A illustrated in FIG. 7 following the thickness of a paper that passes through the second transfer nip. As a result, the detection roller 60 and the detection holder 61 are not negatively affected by the rotational fluctuation of the driven belt 50 including the driven shaft 48 and rotational fluctuation is not easily generated in the driven shaft 48. To prevent generation of the rotational fluctuation of the outer circumference of the detection roller 60 reliably, it is preferable that the detection roller 60 includes a bearing to reduce radial run-out of the detection roller 60.

Further, in the sheet thickness detector 40, the detection roller 60 and the detection holder 61 are disposed closer to the center in the width direction than the driven belt 50*a* including the pulleys 51*a* and 52*a*. As a result, no additional space is provided when installing the detection roller 60 and the detection holder 61, thereby enhancing space-saving.

Further, when the paper P having a small size is conveyed, the thickness of the paper P can be detected while holding the paper P in the second transfer nip formed between the driving roller 41 and the detection roller 60. It is preferable for sheet conveyance that the biasing force that biases the detection roller 60 to the driving roller 41*a* is smaller than the biasing force that biases the driven belt 50 together with the driven shaft 48 to the driving roller 41*a*. As a result, the sheet thickness detector 40 having high accuracy is achieved by preventing a reduction in displacement range of the detection roller 60, thus preventing a reduction in detection sensitivity as well.

The sheet thickness detector 40 further includes a dummy detection roller 64 and a dummy detection holder 65 symmetrically positioned with a displacement mechanism (i.e., a detection roller rotation system 68) including the detection roller 60 and the detection holder 61. Specifically, the dummy detection roller 64 and the detection roller 60 are in symmetrical positions and the dummy detection holder 65 and the detection holder 61 are in symmetrical positions across the center of the belt holder 46 in the width direction. The dummy detection roller 64 has the same form as the detection roller 60 and the dummy detection holder 65 has the same form as the detection holder 61. The biasing force of the spring 62 to bias the detection holder 61 is substantially the same as a biasing force of a spring 66 to bias the dummy detection holder 65. According to this configuration, skew of the paper P can be prevented.

The detection holder 61 further includes a detection lever 63 having a detection target portion of the displacement amount detector where the detection roller 60 detects the amount of displacement following the thickness of the paper P passing through the second transfer nip formed between the driving roller 41 and the detection roller 60. The detection holder 61 further includes a rib 61*d* that is a projection mounted on the top of the detection holder 61.

One end of the detection lever 63 contacts the rib 61*d* of the detection holder 61, so that the detection lever 63 rotates about a pivot 63*a*. The detection lever 63 is provided with an encoder scale that functions as the detection target portion where the encoder 44 functioning as a detection portion detects the range of rotation of the detection lever 63. The encoder scale and the encoder 44 form a displacement amount detector. Together, the detection roller 60, the detection holder 61, the spring 62, the driven shaft 47, the detection lever 63, and the encoder 44 form a thickness detection mechanism 69 that detects the thickness of the paper P.

The detection lever 63 contacts the rib 61*d* of the detection holder 61 but does not contact the surface of the detection roller 60. As a result, the detection roller 60 is less affected by wear of the detection lever 63 and the encoder 44 and contamination by paper dust.

It is to be noted that the sheet thickness detector 40 in FIG. 7 has a configuration in which the spring 62 that is attached to the detection holder 61 biases the detection roller 60 toward the driving roller 41*a*. However, the configuration is not limited thereto. For example, a non-illustrated spring attached to the detection lever 63 can bias the detection roller 60 toward the driving roller 41*a*. However, in the configuration in which the encoder scale functioning as the detection target portion is attached to the detection lever 63, it is preferable that the biasing member that biases the detection lever 63 is different from the biasing member that biases the detection roller 60 to prevent degradation in detection accuracy due to resonance, described later.

In the calculator 45 of the sheet thickness detector 40, a time at which the leading edge of the paper P reaches the sheet feed sensor 43 triggers to acquisition of data from the encoder 44 during a predetermined sampling period. For example, when a linear velocity is 450 mm/s as one cycle of the driving roller 41 having a diameter of 18 mm, the sampling period is calculated as 56.52/450=126 ms. When a timing (a range between papers) in which the paper P is not passing through the second transfer nip acts as a reference time, the calculator 45 calculates the thickness of the paper P by calculating the difference of ranges between a position of the detection roller 60 when the paper P is passing through the second transfer nip and a position thereof when the paper P is not passing therethrough.

The sheet holding/conveying mechanism 55 including the driving roller 41 and the driven belt 50 functioning as a driven sheet conveying member has a periodic fluctuation frequency generating a periodic fluctuation of the driving roller 41 at start-up of the image forming apparatus 1000. When the periodic fluctuation frequency of the sheet holding/conveyance mechanism 55 and a natural frequency of the thickness detection mechanism 69 including the detection roller 60, the detection lever 63 having the encoder scale, and the encoder 44 become equal to each other or an integral multiple thereof, resonance may occur. Resonance becomes especially noticeable when the relation of a natural frequency of a detection roller rotation system 68 functioning as a vibration system including the detection holder 61, the detection roller 60, and the spring 62 and rotating about the driven shaft 47 and a periodic fluctuation frequency of the sheet holding/conveying mechanism 55 are equal to or integral multiples of each other. The resonance between the driving roller 41 and the detection roller rotation system 68 may vibrate the detection roller rotation system 68, which can cause noise in the amount of rotation of the detection lever 63 that detects by the encoder 44, thus preventing proper detection of the thickness of the paper P. As a result, detection accuracy of the sheet thickness detector 40 may deteriorate.

In the sheet thickness detector 40 according to the present embodiment, the natural frequency of the thickness detection mechanism 69, specifically of rotation of the detection roller 60 is set to be different from the frequency of the periodic fluctuation of a sheet holding/conveying mechanism 55.

Figure 10:
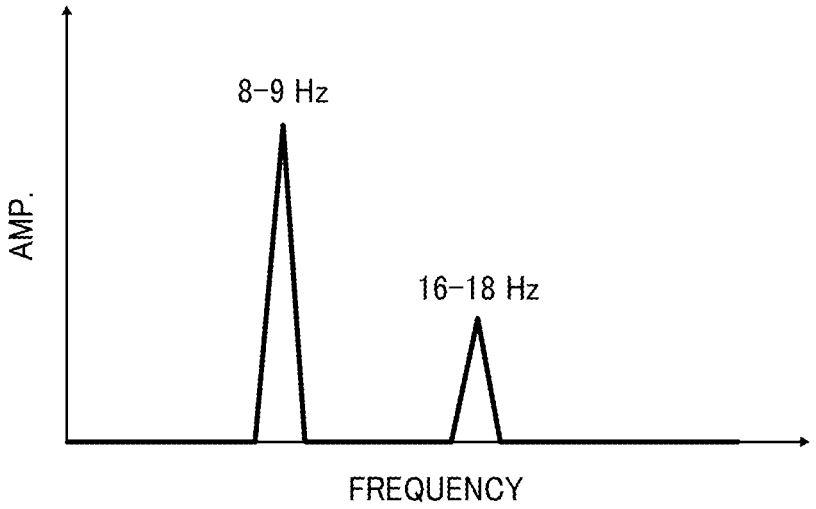
FIG. 10 is a graph showing an example of periodic fluctuation of the sheet conveying member.
Figure 11A:
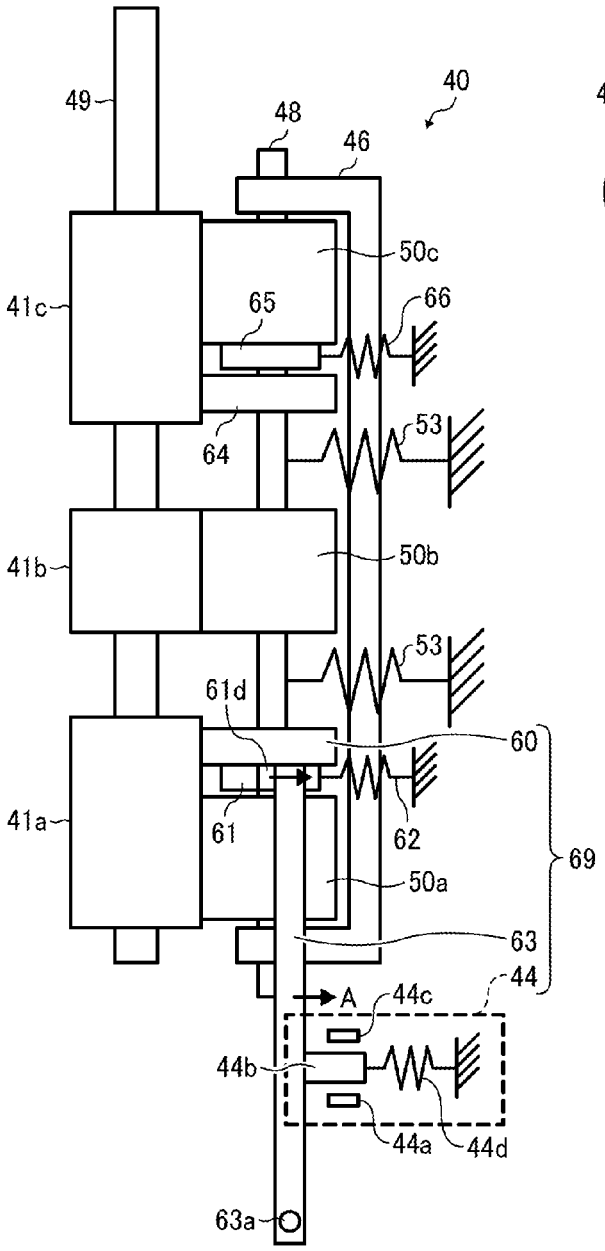
FIG. 11A is a top view illustrating a sheet thickness detector according to another embodiment.
Figure 11B:
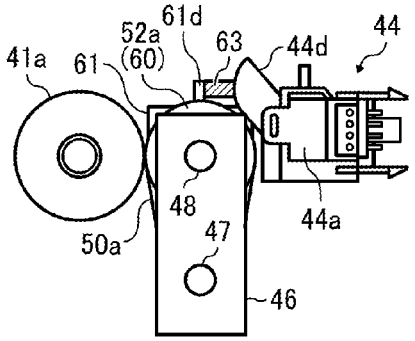
FIG. 11B is a side view illustrating the sheet thickness detector of FIG. 11A.

FIG. 10 is a graph showing an example of periodic fluctuation of the driving roller 41 functioning as a sheet conveying member. FIG. 11A is a top view illustrating the sheet thickness detector 40 of the image forming apparatus 1000 according to another embodiment. FIG. 11B is a side view illustrating the sheet thickness detector 40 of FIG. 11A.

First and second peaks of periodic fluctuation components of the driving roller 41 of the sheet thickness detector 40 according to the present embodiment are visible in the graph of FIG. 10. Specifically, in the sheet thickness detector 40 according to the present embodiment, when the driving roller 41 having a diameter of ϕ18 is rotated at a conveyance speed of 450 mm/s, the first peak is generated at the frequency about 8 Hz to about 9 Hz and the second peak is generated at the frequency about 16 Hz to about 18 Hz. By contrast, in the detection roller rotation system 68, the spring constant of the spring 62 is set to 0.3 N/mm and the total mass of the detection roller 60 and the detection holder 61 is set to 2 g, the natural frequency of the detection roller rotation system 68 is calculated as approximately 60 Hz, estimated based on the formula of $\frac{1}{2}\pi\times\sqrt{(K/m)}$, where "K" represents spring constant and "m" represents mass.

As described above, by designing the sheet thickness detector 40 to have the natural frequency of the detection roller rotation system 68 different from the first and second peaks of the periodic fluctuation components of the driving roller 41 as a periodic fluctuation frequency of the sheet holding/conveying mechanism 55, generation of noise caused by resonance can be prevented, which can contribute to accurate detection of the thickness of a sheet. Namely, the sheet thickness detector 40 can have high accuracy that does not cause resonance with the periodic fluctuation frequency of the sheet holding/conveying mechanism 55.

As the constant of the spring 62 increases, the natural frequency of the detection roller system 68 becomes farther from the frequencies of the first and second peaks of the periodic fluctuation components of the driving roller 41. As a side effect, the amount of displacement of the detection roller 60 decreases, and as a result the sensitivity of the encoder 44 becomes poor, which means that the detection accuracy deteriorates.

Further, a description is given of a configuration having the spring 62 biasing the detection holder 61 and a separate biasing member biasing the detection lever 63, with reference to FIGS. 11A and 11B.

The encoder that detects an amount of displacement in one direction of a detection target member generally uses a component having a detection target portion and a biasing member biasing the component of the detection target portion to the detection target member in a state in which the detection portion is integrally assembled.

The encoder 44 in this configuration includes a rotary member 44*b*, a spring 44*d*, and a light emitting element 44*a* and a light receiving element 44*c* as a detector. These components of the encoder 44 are assembled as a single integrated unit. The rotary member 44*b* has a transmission slit formed therein as a detection target portion provided thereto. The spring 44*d* biases the rotary member 44*b* to the detection lever 63. Then, the spring 44*d* biasing the detection lever 63 toward the rotary member 44*b* of the encoder 44 also serves as a biasing member biasing the detection lever 63 toward the rib 61*d* of the detection holder 61. According to the spring 44*d*, the rotary member 44*b* biases the detection lever 63 toward the rib 61*d* of the detection holder 61 and rotates following the disposition of the detection lever 63 about a non-illustrated rotary shaft that is substantially parallel with the driven shaft 48.

Further, displacement of the detection lever 63 rotates the rotary member 44*b* to allow light emitted by the light emitting element 44*a* to pass through the transmission slit. The light receiving element 44*c* receives the light passing through the transmission slit to detect an amount of rotation of the rotary member 44*b*, thereby detecting an amount of displacement of the detection lever 63 and therefore an amount of displacement of the detection roller 60. Namely, the amount of displacement of the detection roller 60 may be detected based on the amount of rotation of the detection lever 63 by detecting an amount of movement of the transmission slit provided on the rotary member 44*b* by a detector including the light emitting element 44*a* and the light receiving element 44*c*. This configuration can provide the sheet thickness detector 40 that can change a magnification of output and a biasing amount of the sheet thickness detector 40 depending on the position of the transmission slit formed in the rotary member 44*b* or the setting of shape of the rotary member 44*b*. Then, the calculator 45 calculates the thickness of the paper P based on the detection results obtained based on the amount of displacement of the detection roller 60.

By forming the spring 62 that biases the detection holder 61 rotatably supporting the detection roller 60 and the spring 44*d* provided to the encoder 44 and functioning as a biasing member that biases the detection lever 63 as separate parts from each other as described above, even if the conveyance speed of the paper P is changed to change or modify the frequency of a periodic fluctuation of the sheet holding/conveying mechanism 55, a resonance frequency that is the frequency of the periodic fluctuation of the sheet holding/conveying mechanism 55 can be avoided by changing the setting of the spring 62 that biases the detection roller 60 against the driving roller. That is, the natural frequency of the thickness detection mechanism 69 can be changed by finely adjusting the spring constant of the spring 62. Accordingly, even if the conveyance speed of the paper P is changed to change or modify the frequency of the periodic fluctuation of the sheet holding/conveying mechanism 55, the resonance frequency can be avoided without changing the spring 44*d* provided to the encoder 44.

Further, the natural frequency of the thickness detection mechanism 69 can be changed by changing the spring 62 biasing the detection roller 60 to the driving roller 41. Therefore, the encoder 44 to which the spring 44*d* is integrally assembled need not be changed, thereby reducing the cost of modifications.

The springs 62 and 44*d* are used as the biasing members in the present embodiment. However, the configuration is not limited thereto. Alternatively, for example, instead of a compression spring and a tension spring, a flexible member such as a torsion spring, a rubber member, a mylar and the like may be used.

Further, as described above, it is preferable for sheet conveyance that the biasing force of the spring 62 to bias the detection roller 60 against the driving roller 41*a* is smaller than the biasing force of the spring 53 to bias the driven belt 50 (the driven shaft 48) against the driving roller 41. In addition, the sheet thickness detector 40 having high accuracy can be provided by preventing a reduction in displacement range of the detection roller 60 caused by setting the biasing force biasing the detection roller 60 to the driving roller 41*a* to be greater than the biasing force biasing the driven belt 50 together with the driven shaft 48 to the driving roller 41*a* and preventing a reduction in detection sensitivity as well. However, a smaller constant of the spring 62 comes closer to the resonance frequency. Therefore, it is preferable to design the sheet thickness detection 40 to avoid resonance by reducing the mass of each of the members formed for rotation of the detection roller 60.

Further, in the above-described configuration, the natural frequency of the detection roller rotation system 68 that is a vibration system including the detection holder 61, the detection roller 60, and the spring 62 is different from the resonance frequency that is the periodic fluctuation frequency of the sheet holding/conveying mechanism 55. However, the configuration of the present embodiment is not limited thereto. For example, each natural frequency of the components used for forming the thickness detection mechanism 69 may be different from the resonance frequency that is the periodic fluctuation frequency of the sheet holding/conveying mechanism 55. Such a configuration can provide the highly accurate sheet thickness detector 40 that can further prevent resonance.

Further, the driven belts 50*a*, 50*b*, and 50*c* of the present embodiment function as driven sheet conveying members. However, the configuration of the present embodiment is not limited thereto. For example, the sheet conveying member and the driven sheet conveying member can form a pair of conveying members applicable to the configuration of the present embodiment.

Further, the encoder 44 of the present embodiment includes a transmission sensor. However, the configuration of the present invention is not limited thereto. For example, other than the encoder 44, an encoder including or using a reflection sensor may be employed.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet thickness detector comprising:

at least one sheet conveying member configured to rotate and convey a sheet in a sheet conveyance direction;

at least one driven sheet conveying member configured to contact the at least one sheet conveying member and form at least one first transfer nip there between, the at least one driven sheet conveying member being biased to displace by an amount equivalent to a thickness of the sheet passing through the at least one first transfer nip, the at least one driven sheet conveying member rotating about a stationary rotary shaft and a movable rotary shaft in the sheet conveyance direction;

a first displacement member configured to rotate about the movable rotary shaft and form a second transfer nip at a point of contact with the at least one sheet conveying member, the second transform nip being smaller than the at least one first transfer nip in the lateral direction, the first displacement member being biased to displace by an amount equivalent to the thickness of the sheet passing through the second transfer nip;

a first support member having a free end, at which the first displacement member is supported; and a displacement amount detector configured to detect the amount of displacement of the first displacement member.

2. The sheet thickness detector according to claim 1, further comprising:

a calculator configured to calculate the thickness of the sheet based on the amount of displacement detected by the displacement amount detector.

3. The sheet thickness detector according to claim 2, wherein, the at least one driven sheet conveying member comprises a plurality of rollers or a plurality of endless belts wound around a plurality of rollers aligned along the stationary and movable rotary shafts and forming a plurality of first transfer nips, and the first displacement member is disposed between the plurality of rollers or the plurality of endless belts.

4. The sheet thickness detector according to claim 2, wherein the first support member comprises a lever biased at the free end of the lever.

5. The sheet thickness detector according to claim 4, further comprising:

a rotary member mounted on the displacement amount detector;

a first biasing member configured to bias the rotary member against the lever;

a second biasing member configured to bias the at least one driven sheet conveying member against the at least one sheet conveying member; and a third biasing member configured to bias the first displacement member against the at least one sheet conveying member, wherein a biasing force of the third biasing member is smaller than a biasing force of the second biasing member.

6. The sheet thickness detector according to claim 4, further comprising:

a first mechanism including the first displacement member and the displacement amount detector; and a second mechanism including the at least one sheet conveying member and the at least one driven sheet conveying member, wherein a natural frequency of the first mechanism is different from a periodic fluctuation frequency of the second mechanism.

7. The sheet thickness detector according to claim 6, wherein, the displacement amount detector comprises a rotary member biased against the lever, and the displacement amount detector is configured to detect the amount of displacement of the first displacement member based on an amount of rotation of the lever obtained by detecting an amount of movement of a detection target on the rotary member.

8. The sheet thickness detector according to claim 6, further comprising:

a rotary member mounted on the displacement amount detector;

a first biasing member configured to bias the rotary member against the lever; and a second biasing member configured to bias the first displacement member against the at least one sheet conveying member.

9. The sheet thickness detector according to claim 6, wherein each natural frequency of components of the first mechanism is different from each periodic fluctuation frequency of components of the second mechanism.

10. The sheet thickness detector according to claim 2, further comprising:

a second displacement member having a same shape as the first displacement member and a second support member having a same shape as the first support member, wherein the first displacement member and the second displacement member are symmetrically positioned across a center in the lateral direction, and the first support member and the second support member are symmetrically positioned across the center.

11. The sheet thickness detector according to claim 10, wherein a biasing force for biasing the first displacement member against the at least one sheet conveying member is substantially identical to a biasing force for biasing the second displacement member against the at least one sheet conveying member.

12. The sheet thickness detector according to claim 2, further comprising:

a first mechanism including the displacement member and the displacement amount detector; and a second mechanism including the at least one sheet conveying member and the driven at least one sheet conveying member, wherein a natural frequency of the first mechanism is different from a periodic fluctuation frequency of the second mechanism.

13. The sheet thickness detector according to claim 12, wherein each natural frequency of components of the first mechanism is different from each periodic fluctuation frequency of components of the second mechanism.

14. An image forming apparatus comprising:

the sheet thickness detector according to claim 1; and a controller configured to control an image forming process condition based on a detected value obtained by the sheet thickness detector.

15. A sheet thickness detector comprising:

at least one sheet conveying member configured to rotate and convey a sheet in a sheet conveyance direction;

at least one driven sheet conveying member being biased against the at least one sheet conveying member via a first biasing member and configured to contact the at least one sheet conveying member and form at least one first transfer nip there between in a range in a lateral direction perpendicular to the sheet conveyance direction, the at least one driven sheet conveying member being biased to displace by an amount equivalent to a thickness of the sheet passing through the at least one first transfer nip and rotate about a rotary shaft thereof with the at least one sheet conveying member in the sheet conveyance direction;

a displacement member being biased against the at least one sheet conveying member via a second biasing member and configured to contact the at least one sheet conveying member and form a second transfer nip that is smaller than the at least one first transfer nip in the lateral direction, the first displacement member being biased to displace by an amount equivalent to the thickness of the sheet passing through the second transfer nip;

a support member having a free end, at which the displacement member is supported; and a displacement amount detector configured to detect the amount of displacement of the displacement member.

16. The sheet thickness detector according to claim 15, further comprising:

a calculator configured to calculate the thickness of the sheet based on the amount of displacement detected by the displacement amount detector.

17. The sheet thickness detector according to claim 16, wherein, the at least one driven sheet conveying member comprises a plurality of rollers or a plurality of endless belts wound around a plurality of rollers aligned along the rotary shaft and forming a plurality of first transfer nips, and the displacement member is disposed between the plurality of rollers or the plurality of endless belts.

18. A sheet thickness detector comprising:

at least one sheet conveying member configured to rotate and convey a sheet in a sheet conveyance direction;

at least one driven sheet conveying member being biased against the at least one sheet conveying member via a first biasing member and configured to contact the at least one sheet conveying member and form at least one first transfer nip there between in a range in a lateral direction perpendicular to the sheet conveyance direction, the at least one driven sheet conveying member being biased to displace by an amount equivalent to a thickness of the sheet passing through the at least one first transfer nip and rotate about a rotary shaft thereof with the at least one sheet conveying member in the sheet conveyance direction;

a displacement member being biased against the at least one sheet conveying member via a second biasing member and configured to contact the at least one sheet conveying member and form a second transfer nip that is smaller than the at least one first transfer nip in the lateral direction, the first displacement member being biased to displace by an amount equivalent to the thickness of the sheet passing through the second transfer nip;

a support member having a free end, at which the displacement member is supported, the support member including a lever biased at a free end of the lever;

a displacement amount detector configured to detect the amount of displacement of the displacement member; and a rotary member mounted on the displacement amount detector and being biased against the lever via a third biasing member.

19. The sheet thickness detector according to claim 18, further comprising:

a calculator configured to calculate the thickness of the sheet based on the amount of displacement detected by the displacement amount detector.

20. The sheet thickness detector according to claim 19, wherein the at least one driven sheet conveying member comprises a plurality of rollers or a plurality of endless belts wound around a plurality of rollers aligned along the rotary shaft and forming a plurality of first transfer nips, and the displacement member is disposed between the plurality of rollers or the plurality of endless belts.

* * * * *